US007954653B2

(12) United States Patent
Adams et al.

(10) Patent No.: US 7,954,653 B2
(45) Date of Patent: Jun. 7, 2011

(54) ROOM DISPLAY FOR FUNERARY PRODUCTS

(75) Inventors: Jerry David Adams, Batesville, IN (US); Curt Allen Bingham, Sammamish, WA (US); Troy Brake, Nobelsville, IN (US); Brian Carl Gard, Greensburg, IN (US); Joseph Leo Giesey, III, Batesville, IN (US); Nicholas Kaiser, Batesville, IN (US); Gary Joseph Paul Munchel, Oldenburg, IN (US); Daniel J. Parker, Connersville, IN (US); Richard Strohmier, Brookville, IN (US); Mark Steven Williams, Batesville, IN (US); Vernon Charles Wolski, Bismark, ND (US)

(73) Assignee: Batesville Services, Inc., Batesville, IN (US)

( * ) Notice: Subject to any disclaimer, the term of this patent is extended or adjusted under 35 U.S.C. 154(b) by 293 days.

(21) Appl. No.: 11/693,116

(22) Filed: Mar. 29, 2007

(65) Prior Publication Data

US 2008/0236053 A1 Oct. 2, 2008

(51) Int. Cl.
*A47G 29/00* (2006.01)

(52) U.S. Cl. ..... 211/85.16; 211/85.27

(58) Field of Classification Search ..... 211/85.16, 211/85.27, 94.01, 87.01; 312/107, 108, 111, 312/114, 245, 204; 52/128, 134, 136; 27/1, 27/2, 10, 27

See application file for complete search history.

(56) References Cited

U.S. PATENT DOCUMENTS

| | | | | |
|---|---|---|---|---|
| 5,405,017 | A | 4/1995 | Szabo, Sr. et al. | |
| 5,524,394 | A | 6/1996 | Szabo, Sr. et al. | |
| 5,611,124 | A | 3/1997 | Biondo | |
| 5,727,291 | A | 3/1998 | Biondo et al. | |
| 5,787,626 | A * | 8/1998 | Bingham et al. | 40/735 |
| 6,145,671 | A * | 11/2000 | Riga et al. | 211/13.1 |
| 6,145,672 | A * | 11/2000 | Bachman et al. | 211/13.1 |
| 6,276,034 | B1 * | 8/2001 | Bachman et al. | 27/27 |
| 6,467,634 | B1 * | 10/2002 | Pinco | 211/85.16 |
| 6,585,118 | B2 * | 7/2003 | Kellogg | 211/13.1 |
| 6,591,466 | B1 | 7/2003 | Acton et al. | |
| 6,681,510 | B1 * | 1/2004 | Salatin et al. | 40/661 |
| 6,715,677 | B1 * | 4/2004 | Nugent, Jr. | 235/383 |
| 6,836,936 | B1 | 1/2005 | Biondo et al. | |
| 6,928,706 | B2 | 8/2005 | Acton et al. | |
| 6,976,294 | B2 | 12/2005 | Biondo et al. | |
| 7,036,196 | B2 | 5/2006 | Salatin et al. | |
| 7,107,222 | B1 * | 9/2006 | Riga | 705/1 |
| 7,191,906 | B1 * | 3/2007 | Pinco | 211/85.16 |
| 7,308,987 | B2 * | 12/2007 | Richardson et al. | 211/189 |
| 2003/0000901 | A1 * | 1/2003 | Salatin et al. | 211/85.16 |
| 2003/0070145 | A1 * | 4/2003 | Barnes et al. | 715/515 |
| 2004/0073450 | A1 | 4/2004 | Bastianelli et al. | |
| 2005/0000926 | A1 | 1/2005 | Bowers et al. | |
| 2005/0155940 | A1 * | 7/2005 | Bowers et al. | 211/13.1 |
| 2008/0042533 | A1 * | 2/2008 | Wang | 312/259 |

OTHER PUBLICATIONS

Meaningful Memories Kiosk, copyright 2006 Batesville Services Inc.

* cited by examiner

*Primary Examiner* — Janet M Wilkens
*Assistant Examiner* — Dan Rohrhoff
(74) *Attorney, Agent, or Firm* — Wood, Herron & Evans, LLP

(57) ABSTRACT

A display system for casket selection comprises a back wall, actual utilitarian and ornamental casket features mounted to the back wall, and a display adjacent the back wall. The display is operable to display facsimiles of the actual utilitarian and ornamental casket features.

20 Claims, 3 Drawing Sheets

ROOM DISPLAY FOR FUNERARY PRODUCTS

FIELD

This relates generally to the funeral service industry, and more particularly to a display system facilitating the selection by a customer of funerary products in, for example, a funeral home selection room.

BACKGROUND

Funeral home casket selection rooms have evolved as those in the industry have attempted to better meet the funeral customers' needs. The "traditional" presentation of product in a funeral home selection room was to simply place each casket on a bier and open the head end cap or lid of the casket to permit viewing inside the casket. As many caskets as possible were displayed in a selection room in order to maximize the number of product choices for the customer. Unfortunately, such a "traditional" presentation results in what has been referred to as a "sea of caskets" visual effect, which can be both distressing or alarming and confusing to the customer.

Advances in the design of funeral home selection rooms have taken the form of providing a plurality of alcove structures, either of a "modular" construction or of a "stick built" construction, in the funeral home selection room. Each alcove structure includes a vertical back wall and a pair of vertical, spaced apart wing walls cooperating with the back wall to form an alcove. A soffit may span the upper front edges of the wing walls, and lighting, for example track lighting, may be incorporated into the soffit. A two-tier casket rack is located within the alcove, the lower tier of the casket rack being a roll out rack permitting the lower casket to be rolled out from under the upper casket and the casket lid opened for display of the lower casket. Tasteful signage and the like is mounted on the back wall above the caskets. Such a construction, which is the subject of the assignee's U.S. Pat. Nos. 5,405,017 and 5,524,394, both hereby incorporated by reference herein, increases the number of caskets which can be displayed in a funeral home selection room, as well as greatly improves the "look and feel" of the casket presentations, thereby reducing the clutter and confusion of the so-called "sea of caskets" effect and providing a feeling of comfort to the families.

New construction and renovation costs being what they are, there is an ever-increasing need to increase the product density displayable in the funeral home selection room, without sacrificing comfort, convenience and look and feel of the casket display systems of U.S. Pat. Nos. 5,405,017 and 5,524,394. To that end, the assignee's U.S. Pat. No. 7,036,196, hereby incorporated by reference herein, discloses a Display For A Casket Selection And/Or Viewing Room. This patent discloses the display of a plurality of casket portions along with a plurality of casket information modules. Each information module corresponds to one of the casket portions displayed and houses an insert displaying samples of the various features of the particular casket, for example, a portion of the cap panel, a photo of the casket, a fabric swatch of the casket fabric, etc. To access and view the casket samples displayed on the insert, a door to the module is opened, and the insert is slid out of the module.

By way of further advances, the assignee's U.S. Patent Application Publication No. 2005/0000926 A1, hereby incorporated by reference herein, discloses a Display For A Casket Selection Room. This application discloses a display for a casket selection room comprising a wall, a plurality of casket portions displayed on the wall, and a plurality of casket information modules displayed on the wall. Each information module corresponds to one of the casket portions and includes a photo of the casket, a portion of a cap panel of the casket and/or a fabric swatch of the casket. The photo, portion of the cap panel and/or fabric swatch are visible to the customer without opening the information module. The casket selection display of U.S. Patent Application Publication No. 2005/0000926 A1 thereby provides further advantages above and beyond the casket selection display disclosed in U.S. Pat. No. 7,036,196, for example obviating the need to open a door of the casket information module and remove the casket information insert in order to be able to view the same.

By way of still further advances, the Assignee's U.S. Patent Application Publication No. 2005/0155940 A1, hereby incorporated by reference herein, discloses A Display For A Casket Selection Room. That application, the commercial product of which is available from the assignee as its CORNERCOLUMN® display, discloses a display for a casket selection room comprising a base, a first display portion movably mounted to the base for swiveling movement relative thereto about a generally vertical axis, a plurality of casket portions representing a plurality of casket choices from which a customer may select mounted to the first display portion, a second display portion movably mounted to the first display portion for swiveling movement relative thereto about a generally vertical axis, and a plurality of casket ornaments representing a plurality of ornament choices from which the customer may select mounted to the second display portion. By swiveling the displays relative to one another, a customer can position a chosen ornament closely adjacent a chosen casket portion to obtain a general idea of how the casket and ornament combination will appear.

By way of yet further advances, the Assignee's MEANINGFUL MEMORIES® kiosk is an interactive system which seamlessly guides families through the selection process. Incorporating software methodology disclosed in the assignee's U.S. Patent Application Publication No. 2004/0073450 A1 titled Method Of Planning A Funeral Or Other Memorial Service and/or U.S. Patent Application Publication No. 2003/0070145 A1 titled Visual Funeral Planning System, both of which are hereby incorporated by reference herein, the MEANINGFUL MEMORIES® kiosk guides the families through a welcoming message, provides suggestions for concepts and themes for meaningful services, offers guidance in the selection of caskets or cremation products, and suggests personalization features that can add meaning to the service.

It is desirable to provide still further improvements in the area of casket display and selection.

SUMMARY

A display system for casket selection comprises a back wall, actual utilitarian and ornamental casket features mounted to the back wall, and a display adjacent the back wall. The display is operable to display facsimiles of the actual utilitarian and ornamental casket features.

The system can further comprise a pair of side walls attached to the back wall, a base attached to the back wall and the side walls, and a cabinet mounted on the base. The display can be supported atop the cabinet. The display can be a computer display or a litho book containing lithographs. The cabinet can be centrally located between the side walls. The system can further include second and third cabinets mounted on the base, one of which is located on either side of the centrally located cabinet. The computer display can be a touch screen computer display. The utilitarian and ornamental features can be selected from a group consisting of casket cap panels, casket corner ornaments, a casket memorial record system, a casket memorabilia drawer, and casket woods and metals.

The system can further comprise a pair of side walls attached to said back wall, a base attached to the back wall and the side walls, and a valance attached to the side walls. A light can be mounted behind the valance. The system can further comprise first, second, and third cabinets mounted on the base, the first cabinet being centrally located between the side walls, one of the second and third cabinets being located on either side of the first cabinet, the first cabinet being taller than the second and third cabinets, the computer display positioned atop the first cabinet.

These and other features and advantages of the present invention will become more readily apparent during the following detailed description taken in conjunction with the drawings herein, in which:

DRAWINGS

DESCRIPTION

Figure 1:
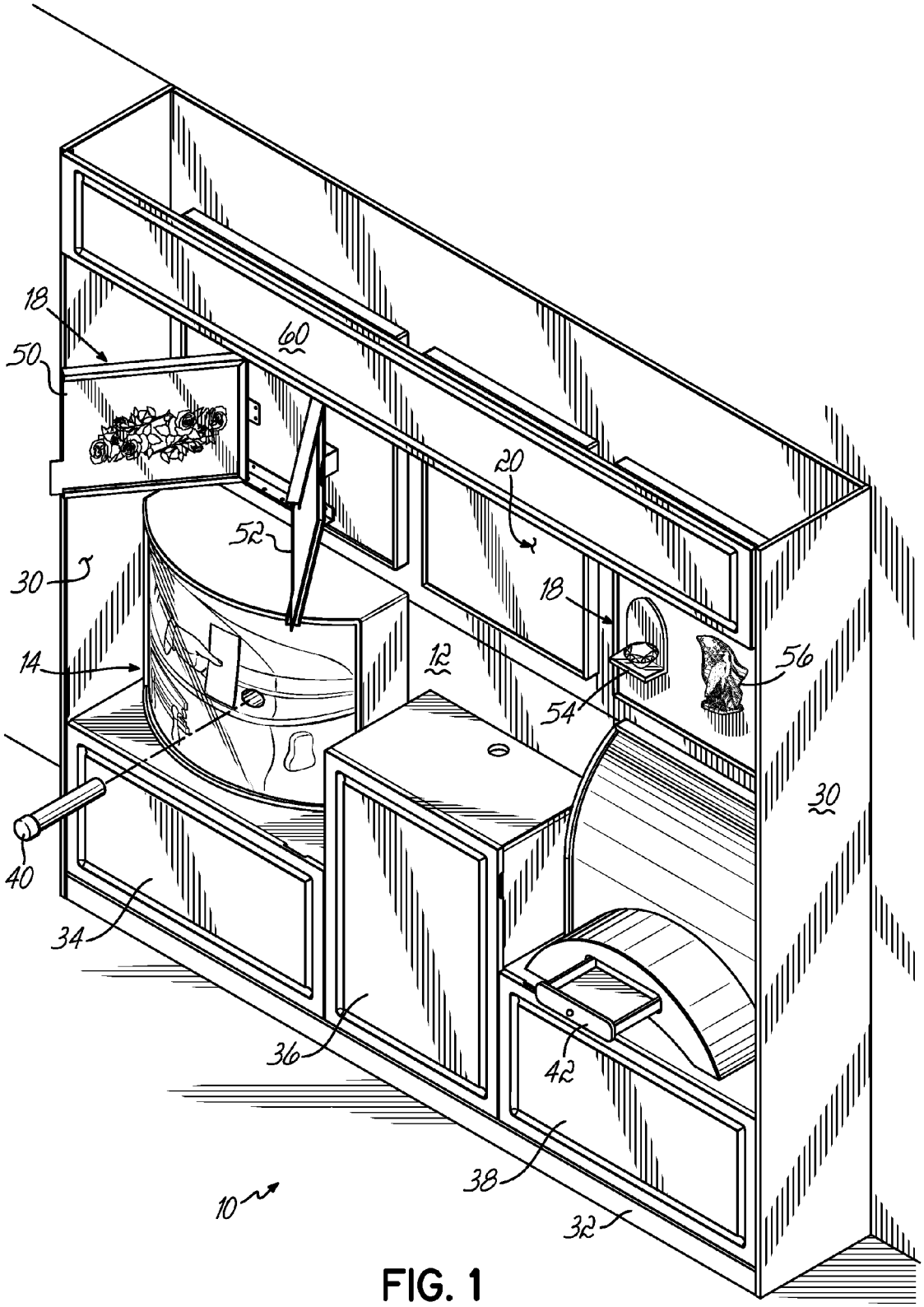
FIG. 1 is a perspective view of the display system.
Figure 2:
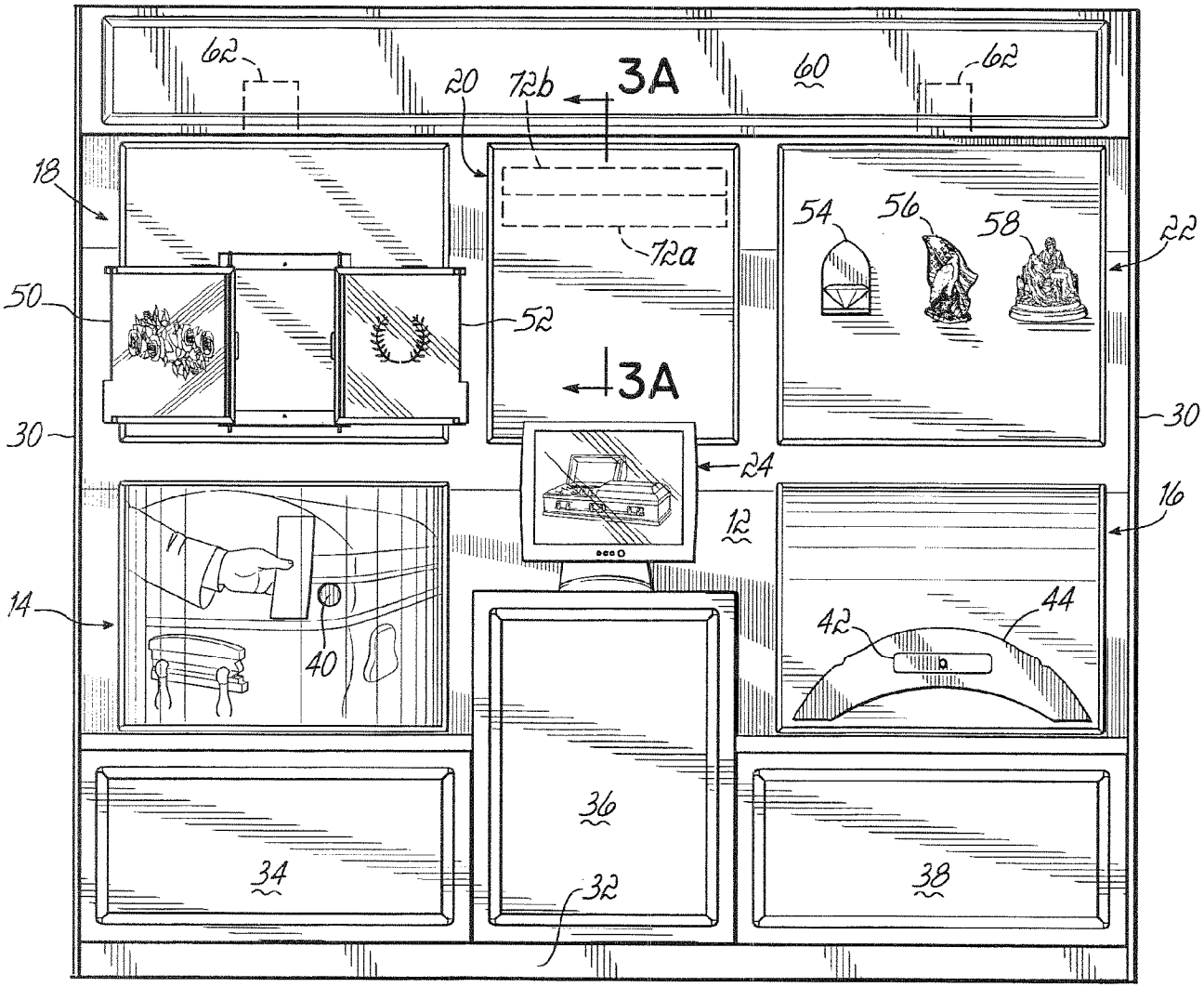
FIG. 2 is a front view of the display system of FIG. 1.

Referring first to FIGS. 1 and 2, a display system 10 for casket selection comprises a back wall 12, actual utilitarian and ornamental casket features 14, 16, 18, 20, 22 mounted to the back wall 12, and a computer display 24 (FIG. 2) adjacent the back wall 12, the computer display 24 being operable to display facsimiles of the utilitarian and ornamental casket features 14, 16, 18, 20, 22.

More particularly, the system 10 can further comprise a pair of side walls 30, 30 attached to the back wall 12, a base 32 attached to the back wall 12 and the side walls 30, 30, and one or more cabinets 34, 36, 38 mounted on the base 32. The computer display 24 can be advantageously supported atop the centrally located cabinet 36, which can be higher than the cabinets 34, 38, in order to place the computer display at a convenient height for standing customers to view. The cabinets 34 and 38 can be utilized for storage, for example for brochures, marketing materials, etc. The computer display 24 can be the same as or similar to the one incorporated into the assignee's MEANINGFUL MEMORIES® kiosk, an interactive system which seamlessly guides families through the selection process. Incorporating software methodology disclosed in the assignee's U.S. Patent Application Publication No. 2004/0073450 A1 titled Method Of Planning A Funeral Or Other Memorial Service and/or U.S. Patent Application Publication No. 2003/0070145 A1 titled Visual Funeral Planning System, both hereby incorporated by reference herein, the MEANINGFUL MEMORIES® kiosk guides the families through a welcoming message, provides suggestions for concepts and themes for meaningful services, offers guidance in the selection of caskets or cremation products, and suggests personalization features that can add meaning to the service. Thus, the computer display 24 can be a touch screen computer display, operable to interactively display, among other things, the utilitarian and ornamental casket features 14, 16, 18, 20, 22 on a casket to aid a customer in visualizing the product. Software, such as that described in the assignee's U.S. Patent Applications Publications Nos. 2003/0070145 A1 and/or 2004/0073450 A1, can be loaded onto a computer (conveniently stored and concealed in cabinet 36) and operated via the touch screen computer display 24. He computer display can also provide the ability to show a consumer video which explains the value differential of available caskets.

Utilitarian and/or ornamental feature 14 can highlight the assignee's MEMORIAL RECORD TUBE™ 40, a tube designed to contain a record of the deceased. The feature 14 can be three-dimensional, appearing to project out of the back wall 12 of the display 10 into the room. Utilitarian and/or ornamental feature 16 can highlight the assignee's MEMORYSAFE® casket drawer 42, a drawer designed as a part of the casket cap 44 to display and/or provide storage of memorabilia of the deceased and/or the deceased's loved ones. The MEMORYSAFE® casket drawer is disclosed in U.S. Pat. Nos. 6,976,294, 6,836,936, 5,727,291, and 5,611,124, hereby incorporated by reference herein. The feature 16 can also be three-dimensional and working model, appearing to project out of the back wall 12 of the display 10 and into the room. Utilitarian and/or ornamental feature 18 can be a pivoting display of different cap panels 50, 52. Utilitarian and/or ornamental feature 20 can be graphical information panel relating to the caskets, and preferably graphical and textual information about the assignee's LIVING MEMORIAL® program, or an explanation of the value progression of casket design and material types. Lastly, utilitarian/ornamental feature 22 can be several casket corner ornaments 54, 56, 58 from the assignee's LIFE SYMBOLS® product line from which a customer can select for attachment to a selected casket. The LIFE SYMBOLS® casket corner ornaments are disclosed in U.S. Pat. Nos. 6,928,706 and 6,591,466, hereby incorporated by reference herein.

The system 10 can further include a valance 60 attached to the side walls 30, 30, and a light 62 mounted behind the valance 60 to illuminate the features 14, 16, 18, 20, and 24.

Figure 3A:
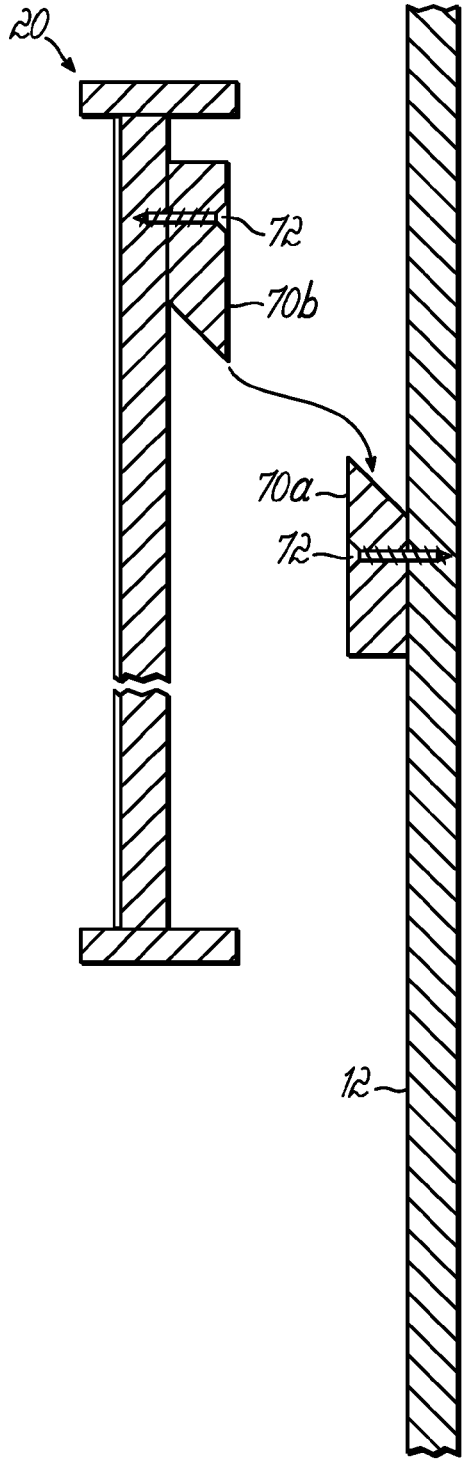
FIG. 3A is a view taken along line 3A-3A in FIG. 2 showing a graphic panel detached from the back wall of the display system.
Figure 3B:
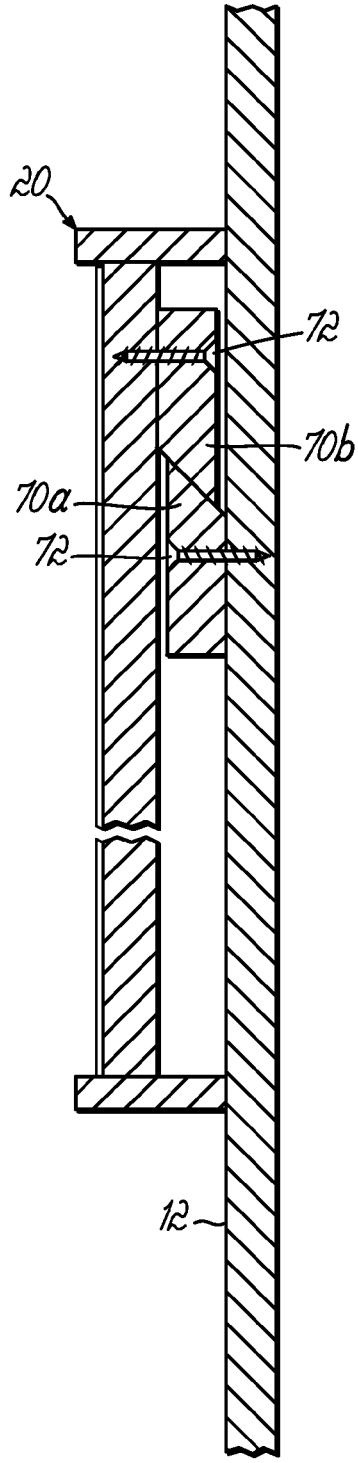
FIG. 3B is a view similar to FIG. 3A but of the graphic panel attached to the back wall of the display system.

FIGS. 3A and 3B show one way that the features 14, 16, 18, 20, and/or 22 can be attached to the back wall 12. Matingly beveled boards 70*a*, 70*b* can be attached to, for example, the display panel 20, as well as back wall 12, respectively, via screws 72, to form a French cleat for removably attached the display panel 20 (and/or the other features 14, 16, 18) to the back wall 12.

The embodiments shown and described are merely for illustrative purposes only. The drawings and the description are not intended to limit in any way the scope of the claims. Those skilled in the art will appreciate various changes, modifications, and alternative embodiments. All such changes, modifications and embodiments are deemed to be embraced by the claims. For example, a litho book containing lithographs of the funeral products can be substituted for the computer display on the cabinet. Accordingly, the scope of the right to exclude shall be limited only by the following claims and their equivalents.

What is claimed is:

1. A display system for casket selection comprising:

a back wall, a pair of side walls attached to said back wall, a base attached to said back wall and said side walls, a cabinet mounted on said base, a touch screen computer display supported atop said cabinet operable to display facsimiles of utilitarian and ornamental casket features, and actual utilitarian and ornamental casket features mounted to said back wall, said features comprising:

a plurality of casket cap panels pivotally mounted to said back wall for pivoting movement about a generally vertical axis, said plurality of casket cap panels being located in an upper region of said back wall adjacent a first lateral edge of said back wall, a plurality of casket corner ornaments mounted to said back wall, said plurality of casket corner ornaments being located in an upper region of said back wall adjacent a second lateral edge of said back wall, an information display panel mounted to said back wall in a central upper region of said back wall, said information display panel including casket graphical and textual information, a casket memorial record tube assembly mounted to said back wall in a lower region of said back wall adjacent one of said first and second lateral edges of said back wall, and a casket memorabilia drawer assembly mounted to said back wall in a lower region of said back wall adjacent the other of said first and second lateral edges of said back wall.

2. The display system of claim 1 wherein said cabinet is centrally located between said side walls, said system further comprising second and third cabinets mounted on said base, one of which is located on either side of said centrally located cabinet, said casket memorial record tube assembly being positioned above one of said second and third cabinets and said casket memorabilia drawer assembly being positioned above the other of said second and third cabinets.

3. The display system of claim 2 wherein said centrally located cabinet is taller than said second and third cabinets.

4. The display system of claim 1 further comprising a valance attached to said side walls and a light mounted behind said valance.

5. The display system of claim 1 further comprising a litho book supported atop the cabinet and containing lithographs of said utilitarian and ornamental casket features.

6. The display system of claim 1 wherein said casket memorial record tube assembly is mounted to a display structure having a convex forward facing display surface, said convex forward facing display surface having a radius of curvature swung about a generally vertical axis and including an end image of a casket applied thereto.

7. The display system of claim 1 wherein said casket memorabilia drawer assembly is mounted to a display structure having a convex forward facing display surface, said convex forward facing display surface having a radius of curvature swung about a generally horizontal axis, said casket memorabilia drawer assembly including an end portion of a casket cap and a memorabilia drawer movably mounted in said casket cap end portion.

8. A display system for casket selection comprising:

a back wall, a pair of side walls attached to said back wall, a base attached to said back wall and said side walls, a cabinet mounted on said base, a touch screen computer display supported atop said cabinet operable to display facsimiles of utilitarian and ornamental casket features, and actual utilitarian and ornamental casket features mounted to said back wall, said features comprising:

a plurality of casket cap panels located in an upper region of said back wall adjacent a first lateral edge of said back wall, a plurality of casket corner ornaments located in an upper region of said back wall adjacent a second lateral edge of said back wall, an information display panel located in a central upper region of said back wall, a casket memorial record tube display assembly mounted to said back wall in a lower region of said back wall adjacent one of said first and second lateral edges of said back wall, and a casket memorabilia drawer display assembly mounted to said back wall in a lower region of said back wall adjacent the other of said first and second lateral edges of said back wall.

9. The display system of claim 8 wherein said cabinet is centrally located between said side walls and wherein said system further comprises second and third cabinets mounted on said base, one of which is located on either side of said centrally located cabinet.

10. The display system of claim 9 wherein said centrally located cabinet is taller than said second and third cabinets.

11. The display system of claim 10 wherein said second and third cabinets are the same height.

12. The display system of claim 11 wherein said casket memorial record tube display assembly is positioned closely above one of said second and third cabinets and said casket memorabilia drawer display assembly is positioned closely above the other of said second and third cabinets.

13. The display system of claim 8 further comprising a valance attached to said side walls and a light mounted behind said valance.

14. The display system of claim 8 wherein said plurality of casket cap panels are pivotally mounted relative to said back wall for pivoting movement about a generally vertical axis.

15. The display system of claim 8 wherein said plurality of casket cap panels are pivotally mounted to a planar member for pivoting movement about a generally vertical axis, and said planar member is removably attached to said back wall via a French cleat.

16. The display system of claim 8 wherein said information display panel includes text and graphics relating to at least one of a memorial program and casket information, and wherein said information display panel is removably attached to said back wall via a French cleat.

17. The display system of claim 8 wherein said plurality of casket corner ornaments are mounted to a planar member and said planar member is removably attached to said back wall via a French cleat.

18. The display system of claim 8 wherein said casket memorial record tube display assembly and said casket memorabilia drawer display assembly project from said back wall by a greater distance than said plurality of casket cap panels, said plurality of casket corner ornaments, and said information display panel project from said back wall.

19. The display system of claim 18 wherein said casket memorial record tube display assembly comprises:

a display structure having a convex forward facing display surface, said convex forward facing display surface having a radius of curvature swung about a generally vertical axis, said display surface including an image of an end of a casket applied thereto, and a memorial record tube assembly mounted to said display structure so as to appear to be mounted in a corner of the end of the casket image applied to said display surface.

20. The display system of claim 18 wherein said casket memorabilia drawer display assembly comprises:

a display structure having a convex forward facing display surface, said convex forward facing display surface having a radius of curvature swung about a generally horizontal axis, an end portion of a casket cap mounted to said display structure, and a memorabilia drawer movably mounted in said end portion of said casket cap.

* * * * *